US010336945B2

(12) United States Patent
Spicer et al.

(10) Patent No.: US 10,336,945 B2
(45) Date of Patent: Jul. 2, 2019

(54) PROCESS AND APPARATUS FOR DECOKING A HYDROCARBON STEAM CRACKING FURNACE

(71) Applicant: ExxonMobil Chemical Patents Inc., Baytown, TX (US)

(72) Inventors: David B. Spicer, Houston, TX (US); Subramanian Annamalai, Choa Chu Kang (SG); James M. Frye, Tokyo (JP)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 14/821,451

(22) Filed: Aug. 7, 2015

(65) Prior Publication Data

US 2016/0168478 A1 Jun. 16, 2016

Related U.S. Application Data

(60) Provisional application No. 62/042,920, filed on Aug. 28, 2014, provisional application No. 62/092,623, filed on Dec. 16, 2014.

(30) Foreign Application Priority Data

Apr. 28, 2015 (EP) ..... 14191533

(51) Int. Cl.
*C10G 69/06* (2006.01)
*C10G 9/16* (2006.01)
(Continued)

(52) U.S. Cl.
CPC ..... *C10G 9/16* (2013.01); *B08B 3/00* (2013.01); *C10G 9/20* (2013.01); *C10G 9/36* (2013.01);
(Continued)

(58) Field of Classification Search
None
See application file for complete search history.

(56) References Cited

U.S. PATENT DOCUMENTS 3,593,968 A 7/1971 Geddes
3,758,081 A 9/1973 Prudhon
(Continued)

FOREIGN PATENT DOCUMENTS

CN 102329633 A 1/2012
WO 2010/005633 A 1/2010

OTHER PUBLICATIONS

Farlex, rate of flow, 2012, Farlex, definition rate of flow.*
(Continued)

*Primary Examiner* — Douglas Lee
*Assistant Examiner* — Ryan L. Coleman

(57) ABSTRACT

A process for the decoking of a hydrocarbon steam cracking furnace having a firebox, radiant coils, a transfer line exchanger, and an oil quench connection wherein liquid quench oil is injected to directly cool the steam-cracked effluent. Decoking feed comprising steam and air is supplied to the furnace under conditions sufficient to at least partially combust coke accumulated on the interior of the radiant coils, the transfer line exchanger, and the quench connection. Quench steam is supplied and injected into the decoking process effluent in an amount sufficient to cool the decoking process effluent below the metallurgical temperature limit of downstream piping. Also, a pyrolysis furnace for the production of ethylene is also provided.

9 Claims, 3 Drawing Sheets

(51) Int. Cl.
*C10G 9/20* (2006.01)
*B08B 3/00* (2006.01)
*C10G 9/36* (2006.01)

(52) U.S. Cl.
CPC . *C10G 2300/802* (2013.01); *C10G 2300/807* (2013.01)

(56) References Cited

U.S. PATENT DOCUMENTS 3,907,661 A 9/1975 Gwyn et al.
3,959,420 A 5/1976 Geddes et al.
4,444,697 A 4/1984 Gater et al.
4,828,681 A * 5/1989 Yourtee ..... C10G 9/32 208/126
5,061,408 A 10/1991 Hüning et al.
5,183,642 A 2/1993 Lenglet
5,186,815 A 2/1993 Lenglet
6,089,012 A * 7/2000 Sugishita ..... F01K 23/106 60/39.182
6,626,424 B2 9/2003 Ngan et al.
6,632,351 B1 10/2003 Ngan et al.
7,090,765 B2 8/2006 Spicer et al.
7,097,758 B2 8/2006 Stell et al.
7,138,047 B2 11/2006 Stell et al.
7,220,887 B2 5/2007 Stell et al.
7,235,705 B2 6/2007 Stell
7,244,871 B2 7/2007 Stell et al.
7,247,765 B2 7/2007 Stell et al.
7,297,833 B2 11/2007 Beattie et al.
7,311,746 B2 12/2007 Stell et al.
7,312,371 B2 12/2007 Stell et al.
7,351,872 B2 4/2008 Stell et al.
7,488,459 B2 2/2009 Stell et al.
7,578,929 B2 8/2009 Stell et al.
7,820,035 B2 10/2010 McCoy et al.
8,177,200 B2 5/2012 Spicer et al.
8,684,384 B2 4/2014 Spicer et al.
2005/0261532 A1 11/2005 Stell et al.
2008/0128323 A1 6/2008 McCoy et al.
2009/0280042 A1 11/2009 McCoy et al.
2010/0320119 A1 12/2010 Ou et al.
2013/0239999 A1 9/2013 Bhirud

OTHER PUBLICATIONS

MetalTek International, Ask the Metals Experts Glossary, Oct. 13, 2016, 10 paragraphs.*
Amrita, Newton's Law of Cooling, 2016, title, copyright, one paragraph discussing terperature, cooling and energy flow.*
ASME, Overview of Process Plant Piping System Design, 2016, Follow Science, Tittle, 10 passages discussing piping.*
Hackerman, Effect of Temperature on Corrosion of Metals by Water, Aug. 1952, Ind. Eng. Chem., 44 (8), tittle and two passages.*
Fushun Petroleum Research Institute, "Oil refinery sewage treatment practice", Petrochemical Industry Publishing Co., pp. 48-49, 1978.

* cited by examiner

PROCESS AND APPARATUS FOR DECOKING A HYDROCARBON STEAM CRACKING FURNACE

CROSS-REFERENCE TO RELATED APPLICATIONS

This application claims priority to and the benefit of U.S. Provisional Application Ser. No. 62/042,920, filed Aug. 28, 2014, EP 14191533.0 filed Apr. 28, 2015, and U.S. Provisional Application Ser. No. 62/092623 filed Dec. 16, 2014, which are all incorporated herein by reference.

FIELD OF THE INVENTION

The present invention relates to the field of thermal cracking hydrocarbons for the production of olefins, particularly low molecular weight olefins such as ethylene. More particularly the invention relates to methods and equipment for removal of coke deposits that form during such thermal cracking processes.

BACKGROUND OF THE INVENTION

Steam cracking, also referred to as pyrolysis, is used to crack various hydrocarbon feedstocks into olefins, preferably light olefins such as ethylene, propylene, and butenes. Conventional steam cracking utilizes a pyrolysis furnace that has a firebox and radiant coil section, among other features. The hydrocarbon feedstock typically enters the furnace as a liquid (except for light feedstocks which enter as a vapor) wherein it is heated and at least partially vaporized by indirect contact with hot flue gas and by direct contact with steam.

The vaporized feedstock and steam mixture is then introduced into the radiant coil section where the pyrolysis cracking chemistry primarily takes place. The resulting products comprising olefins leave the radiant coils and are quenched to halt further pyrolysis reactions.

Conventional steam cracking systems have been effective for cracking high-quality liquid feedstocks which contain fully volatile hydrocarbons, such as gas oil and naphtha. Additionally, steam cracking economics sometimes favor cracking lower cost feedstocks containing resids such as, by way of non-limiting examples, atmospheric residue such as atmospheric pipe still bottoms, and crude oil. For feedstocks containing resids, a vapor liquid separator, for example a vapor liquid separator as described in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705, which are incorporated by reference herein in their entirety, is used to remove non-volatile components that promote coking when cracked. Cracked effluent from furnaces processing these liquid feeds can also be quenched in at least a primary transfer line exchanger (TLE). For heavier liquids, e.g., heavier naphthas and all gas-oil feeds, a direct oil quench connection is often required downstream of the primary TLE. The oil quench connection allows addition of quench oil into the pyrolysis product stream to provide heat transfer from the product stream directly to the injected quench oil.

A problem with direct oil quench connections is the tendency to plug rapidly when the relatively cold quench oil contacts the hot pyrolysis effluent. Oil quench fittings have been designed as a specialized technology for the addition of oil into the furnace effluent in a manner that does not cause rapid plugging.

Steam cracking, especially steam cracking of heavier feeds, such as kerosenes and gas oils, produces large amounts of tar, which leads to rapid coking in the radiant coils, TLE, and quench connection of the furnace. Frequent feed interruptions are required to enable coke removal through a process known as decoking. Within the industry, the normal method of removing coke from the radiant coils of a cracking furnace is decoking. During this process, hydrocarbon feed is interrupted to the furnace and steam passes through the furnace. The furnace effluent is redirected from the recovery section of the olefins plant to a decoking system. Air is added to the steam passing through the furnace and the heated air/steam mixture removes the coke deposits by controlled combustion. The decoke effluent is eventually exhausted to the atmosphere, either via a decoke drum, e.g., a cyclonic separator, or via the furnace firebox and stack.

During the decoking of a furnace having a quench fitting, it is not possible to add quench oil through the quench fitting to cool the radiant coil and TLE effluent, as release of the quench oil to atmosphere is unacceptable. It is conventional to add water into the quench fitting to cool the decoking effluent. However, much less water is required to cool the decoke effluent than quench oil required to cool the pyrolysis effluent. Maldistribution results when the flow of water is below the quench fitting design oil flow rates. The maldistribution leads to stratified flow in the downstream piping where the vapor stream in the majority of the pipe cross section is much hotter than the liquid stream running along the bottom of the pipe. This leads to uneven and variable temperature gradients around the pipe which, over time, can lead to thermal fatigue failures of the pipe and flange leaks. Additionally, the large temperature difference between the vapor and liquid streams in the piping makes control of the quench water addition rates to maintain a stable temperature difficult since a temperature sensor in the pipe is contacted by the hot vapor or relatively cold liquid stream. The rapid cycling of measured temperature leads to rapid cycling of quench water addition rate, further increasing the thermal fatigue of the piping.

Therefore, a process is desired for removing coke from a steam cracking furnace having a transfer line exchanger and oil quench connection that reduces or prevents stratified flow, provides improved decoking effluent temperature control and reduces mechanical fatigue of piping downstream of the oil quench fitting.

SUMMARY OF THE INVENTION

A decoking process utilizing steam ("quench steam") rather than liquid water injection for cooling the effluent from the process reduces or prevents stratified flow, provides improved decoking effluent temperature control and reduces mechanical fatigue of piping downstream of the oil quench fitting. Quench steam avoids stratified flow and provides tighter control of the decoking process effluent temperature. Tighter control allows the target effluent temperature to be optimized and set closer to the upper metallurgical temperature limit of the downstream piping. This provides a cost saving optimization by avoiding over quenching of the process effluent that can be realized, for example, in reduced quench steam demand. Additionally, providing non-stratified (vapor phase only) flow that is substantially free of liquid water is advantageous, for example, when the decoking effluent is directed into the furnace firebox. In such applications, any liquid water entering the firebox would instantly vaporize with a corresponding rapid increase in volume that could damage the firebox insulation system. Utilizing quench steam instead of quench water avoids this problem.

One feature of the invention is a decoking process for removing coke formed during steam cracking of a hydrocarbon feed in a furnace having a firebox, radiant coils, a transfer line exchanger, and an oil quench connection wherein liquid quench oil is injected to directly cool the steam-cracked hydrocarbon. The process comprises several steps. First, the flow of hydrocarbon feed to the furnace and flow of quench oil to the oil quench connection is stopped. Second, a decoking feed comprising steam and air is supplied to the furnace under conditions sufficient to at least partially combust coke accumulated on the interior of the radiant coils, the transfer line exchanger, and the quench connection. Third, quench steam is supplied and injected into the decoking process effluent in an amount sufficient to cool the decoking process effluent below the metallurgical temperature limit of downstream piping.

Also disclosed is a pyrolysis furnace suitable for carrying out the inventive decoking process. The pyrolysis furnace comprises a number of elements. A hydrocarbon feed conduit and a dilution steam conduit in fluid communication with the hydrocarbon feed conduit is described. The dilution steam conduit facilitates mixture of the dilution steam and the hydrocarbon feed. A radiant coil in fluid communication with the combined steam and hydrocarbon feed is also provided. A firebox heats the exterior of the radiant coil to provide a cracked hydrocarbon effluent from the radiant coil. A transfer line exchanger in fluid communication with the radiant coil is described to provide indirect heat transfer for cooling the hydrocarbon effluent. Additionally, an oil quench connection in fluid communication with the transfer line exchanger is described to provide direct heat transfer by injection of quench oil into the hydrocarbon effluent. Finally, a quench steam connection in fluid communication with the oil quench connection is included for injecting quench steam during decoking.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION OF PREFERRED EMBODIMENTS

Various aspects will now be described with reference to specific embodiments selected for purposes of illustration. It will be appreciated that the spirit and scope of the process and system disclosed herein is not limited to the selected embodiments. Moreover, it is to be noted that the figures provided herein are not drawn to any particular proportion or scale, and that many variations can be made to the illustrated embodiments. Reference is now made to the figures, wherein like numerals are used to designate like parts throughout. When an amount, concentration, or other value or parameter is given as a list of upper preferable values and lower preferable values, this is to be understood as specifically disclosing all ranges formed from any pair of an upper preferred value and a lower preferred value, regardless whether ranges are separately disclosed. Feedstocks that may be employed herein may be any feedstock adapted for cracking insofar as they may be cracked into various olefins, and may contain heavy fractions such as high-boiling fractions and evaporation residuum fractions.

Figure 1:
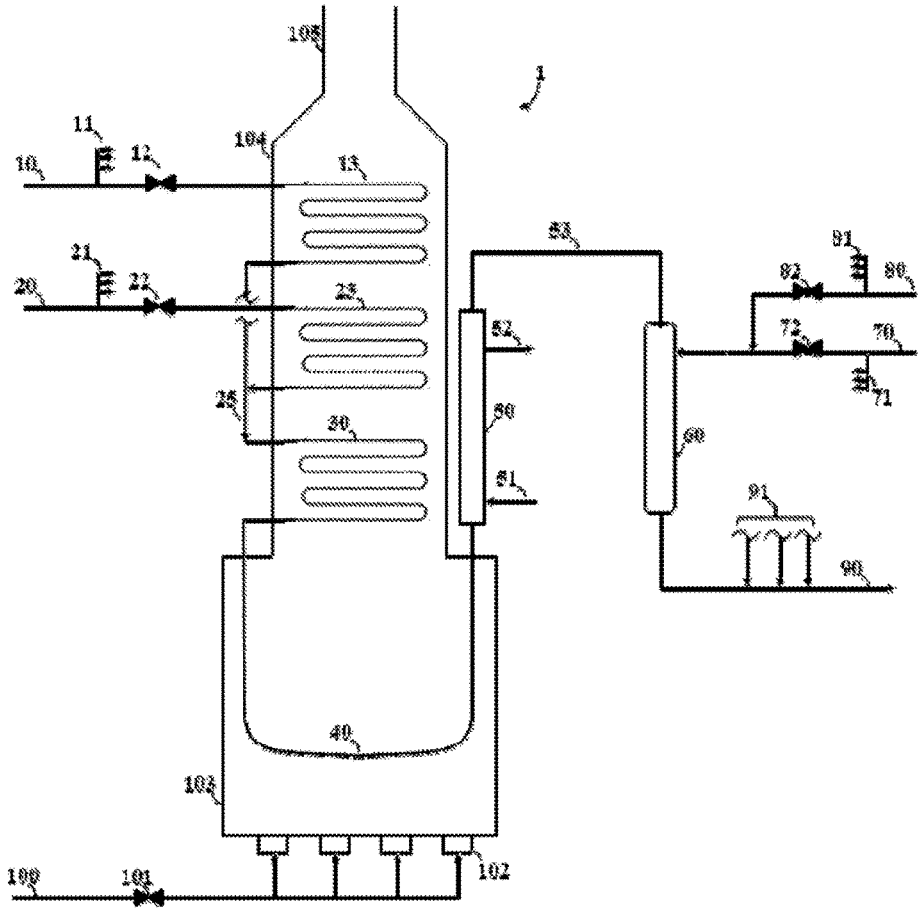
Figure 1 Prior Art
FIG. 1 illustrates a schematic flow diagram of a conventional steam-cracking process employed with a pyrolysis furnace, transfer line exchanger, and direct oil quench fitting that uses water injection in the quench fitting during decoking.

Referring now to FIG. 1, a pyrolysis furnace 1 includes a radiant firebox 103, a convection section 104 and flue gas exhaust 105. Fuel gas is provided via conduit 100 and control valve 101 to radiant burners 102 that provide radiant heat to a hydrocarbon feed to produce the desired pyrolysis products by thermal cracking of the feed. The burners generate hot gas that flows upward through the convection section 104 and then out of the furnace to atmosphere via the flue gas exhaust 105.

Hydrocarbon feed is conducted via conduit 10 and control valve 12 to a preheating conduit 13 in convection section 104 where the feed is preheated by indirect contact with hot flue gas. A plurality of feed conduits 11 are arranged in parallel. Although not shown, each of the plurality of feed conduits 11 may be provided with a control valve 12. Each of the plurality of conduits 11 is in fluid communication with a corresponding preheating conduit (not shown) in parallel to preheating conduit 13 in convection section 104. The use of the term "plurality of conduits" is meant to refer to the fact that the convection section 104 is arranged wherein each multiple preheating conduit bank has at least two conduits in parallel. Four conduits are represented in FIG. 1, although furnaces having 3, 4, 6, 8, 10, 12, 16, 18 parallel conduits are known.

After the preheated hydrocarbon feed exits the preheating conduit 13, the preheated hydrocarbon feed is mixed with dilution steam. Dilution steam is provided via conduit 20 through control valve 22 to steam preheating conduit 23 in convection section 104 where the dilution steam is preheated by indirect contact with hot flue gas. Dilution steam is added to provide the amount of H2O required to achieve the desired hydrocarbon partial pressure during pyrolysis reaction. A plurality of steam conduits 21 may be provided corresponding to the plurality of feed conduits 11.

The mixture of dilution steam and preheated hydrocarbon feed is conducted via conduit 25 to heat exchange conduit 30 in convection section 104. Optionally for hydrocarbon feeds containing resids, the dilution steam and preheated hydrocarbon feed mixture can be conducted to a vapor liquid separator (not shown) to remove non-volatile hydrocarbon components that promote coking when cracked. A plurality of heat exchange conduits (not shown) may be provided.

Upon exiting the heat exchange conduit 30, the heated mixture is passed to radiant coil 40 in radiant section 103 for thermal cracking of the hydrocarbon. A plurality of radiant coils (not shown) may be provided. The temperature of the heated mixture exiting conduit 30 is generally designed to be at or near the point where significant thermal cracking commences. The temperature of the thermally cracked hydrocarbon exiting the radiant coil 40 can vary from about 790° C. (1450° F.) for some very heavy gas oil feeds to about 900° C. (1650° F.) for ethane or propane feeds.

After the desired degree of thermal cracking has been achieved in the radiant section 103, the furnace effluent is rapidly cooled. For this purpose, the furnace effluent is conducted to one or a series of more than one indirect transfer line heat exchanger(s) (TLE) 50 where the heat energy from the furnace effluent is indirectly transferred to heat water provided via conduit 51 to produce high pressure steam conducted away via conduit 52. This technique is generally favored as the high pressure steam produced may be further superheated and used to power steam-turbines useful in the process to separate and recover ethylene from the furnace effluent.

However, for some heavy liquid feeds such as heavy naphthas and gas oils containing crude oil residues, the use of transfer line exchangers alone is not possible due to rapid fouling of the TLE exchanger 50. Crude oil and atmospheric residue often contain high molecular weight, non-volatile components with boiling points in excess of 595° C. (1100° F.). Pyrolysis of the non-volatile components of these feedstocks produces coke deposits on the inner surfaces of the TLE 50. As the TLE fouls, high pressure steam generation rates are reduced and the effluent temperature leaving the TLE 50 rises above the desired operating temperature for downstream equipment. For example, in some cases the temperature leaving the TLE 50 rises as high as 675° C. (1250° F.). In such cases, a direct oil quench connection is often required downstream of the TLE. The oil quench connection allows addition of quench oil into the furnace effluent stream to provide heat transfer from the furnace effluent directly to the injected quench oil. In such a quench connection, the furnace effluent is cooled primarily by the vaporization of the quench oil.

A problem with direct oil quench connections is the tendency to cause rapid plugging when the relatively cold quench oil contacts the hot pyrolysis effluent. Oil quench fittings have been designed as a specialized technology for the addition of oil into the furnace effluent in a manner that does not cause rapid plugging. Non-limiting examples of oil quench fitting designs that are incorporated here by reference in their entirety may be found in U.S. Pat. Nos. 8,177,200; 3,593,968; 6,626,424; 3,907,661; 4,444,697; 3,959,420; 5,061,408; and 3,758,081. For example, the quench oil may be injected through spray nozzles in the quench fitting. In another example, the quench oil is added in a manner to form a continuous liquid film on a cylindrical wall of the quench fitting. Still other examples add the quench oil through a single port in the quench fitting. Yet another example adds oil through a grooved circumferential slot in the quench fitting so as to create liquid film along the wall of the fitting. Another non-limiting example adds oil through a porous jacket into the furnace effluent stream.

The partially cooled furnace effluent leaving TLE 50 is conducted via conduit 53 to direct oil quench fitting 60. Quench oil, preferably a distillate oil and more preferably an aromatic-containing distillate oil, is provided via conduit 70 and valve 72. A plurality of quench oil conduits 71 may be provided. Preferred liquid quench fluids 70 that may be particularly useful may include a liquid quench oil, such as an aromatic oil. Preferred aromatic oil may have a final boiling point of at least about 400° C. (750° F.). Other particularly useful liquid quench fluid may include an aromatic distillate, such as a distillate that is recovered from cooled furnace effluent stream 90.

Sufficient quench oil 70 is combined with partially cooled furnace effluent 53 in direct quench fitting 60 to ensure the temperature of the cooled furnace effluent 90 is appropriate for feeding downstream separation equipment, for example, a primary fractionator (not shown) that receives furnace effluent at about 288° C. (550° F.) to 315° C. (600° F.). A plurality of direct quench fitting effluent conduits 91 may be provided.

Regardless of the hydrocarbon feedstock being cracked, over time an undesirable but largely unavoidable byproduct of the cracking process is the deposition of carbon deposits (coke) on the inner surfaces of the convection section preheating conduits, radiant section radiant coils, TLEs, and even direct oil quench connections. Of primary concern is coke build up on the internal surfaces of the radiant tubes that reduces the effective cross-sectional area of the tube, thereby necessitating higher pressures to maintain a constant throughput. Since coke is an effective insulator, its formation on tube walls also must be accompanied by an increase in furnace tube temperature to maintain cracking efficiency. High operating temperatures, however, result in a decrease in tube life, which limits the practical temperature that can be employed, as well as the ultimate conversion and yield.

The conventional method of removing coke from the radiant coils of a cracking furnace is decoking. Referring again to FIG. 1, during decoking, the hydrocarbon feed 10 is interrupted to the furnace and steam 20 continues passing through the furnace. The furnace effluent 90 is redirected away from the recovery section of the olefins plant (not shown) to atmosphere. Air is added via conduit 10 to the steam passing through the furnace to create a decoking feed air/steam mixture 25. The air/steam mixture is heated in radiant coils 40 to remove at least a portion of the coke deposits by controlled combustion. The effluent from radiant coils 40 is cooled in transfer line exchanger 50 and in quench fitting 60. Because the decoking process effluent is ultimately exhausted to atmosphere, it is conventional to substitute water in place of the quench oil for injection at the quench fitting 60. The flow of quench oil in conduit 70 is halted via valve 72 at the beginning of the decoking process. Water is introduced via conduit 80 and valve 82 and injected into quench fitting 60. A plurality of water conduits 81 may be provided. The cooled effluent 90 is then exhausted to the atmosphere, either via a decoke drum, e.g., a cyclonic separator (not shown), or via the furnace firebox 103 and flue gas exhaust 105.

Much less water is required to cool the decoke effluent than quench oil required to cool the pyrolysis effluent, for example, 3 Mg/hr (1.0 Mg=$1.0\times10^6$ grams) water used during decoking for every 40 Mg/hr quench oil used during steam cracking. Maldistribution results when the flow of water is below the quench fitting design oil flow rates. The maldistribution leads to stratified flow in the downstream piping where the vapor stream in the majority of the pipe cross section is much hotter than the liquid stream running along the bottom of the pipe. This leads to uneven and variable temperature gradients around the pipe which, over time, can lead to thermal fatigue failures of the pipe and flange leaks.

Additionally, the large temperature difference between the vapor and liquid streams in the piping makes control of the quench water addition rates to maintain a stable temperature difficult since a temperature sensor in the pipe is contacted by the hot vapor or relatively cold liquid stream. The partially combusted coke vapor effluent 90 must be cooled sufficiently below metal temperature limits of the downstream piping, e.g., less than 450° C. (840° F.) for carbon steel. Because of the variation in measured temperature, it is customary to design the water quench control system to operate with a temperature setpoint comfortably below the metal temperature limits, e.g., 315° C. (600° F.)-340° C. (645° F.) for carbon steel. Even so, the rapid cycling of measured temperature leads to rapid cycling of quench water addition rate, further increasing the thermal fatigue of the piping.

Figure 2:
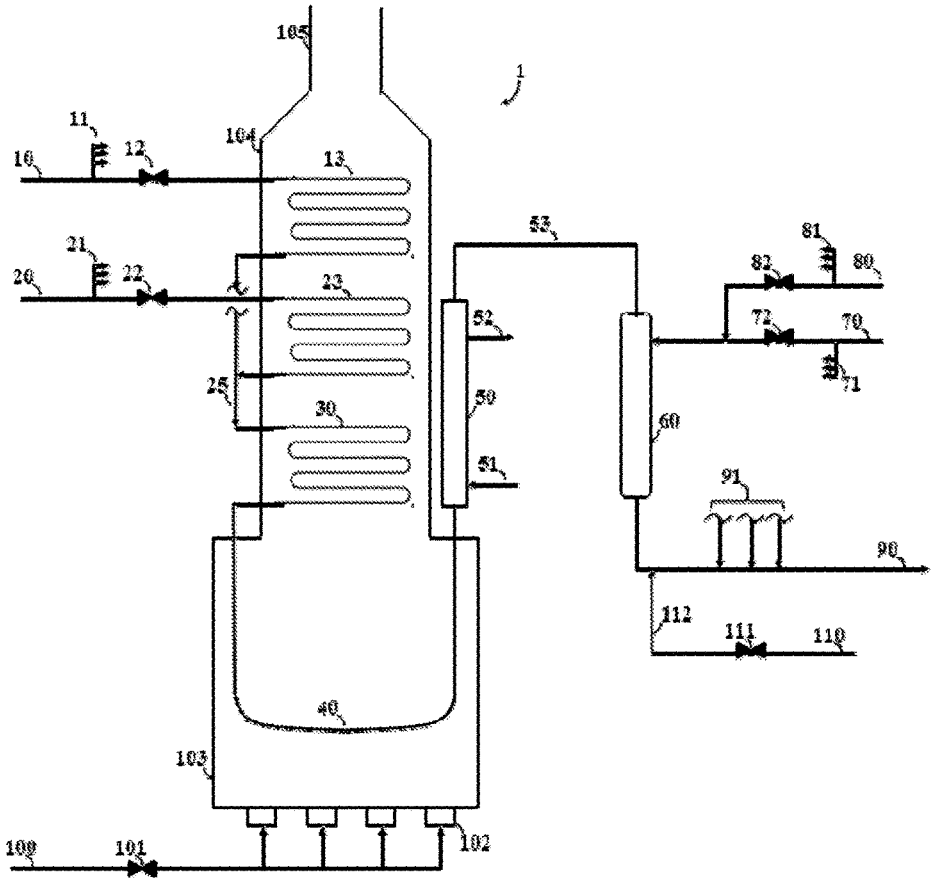
FIG. 2 illustrates a schematic diagram of a pyrolysis furnace as well as a decoking process as disclosed herein, utilizing steam injection in the quench fitting during decoking.

Accordingly, the invention described herein does not use the conventional decoking process. More particularly, the invention utilizes steam rather than water injection for cooling the effluent from the process. Utilizing steam instead of liquid water reduces or prevents stratified flow, provides improved decoking effluent temperature control and reduces mechanical fatigue of piping downstream of the oil quench fitting. Referring now to FIG. 2, where like numerals indicate like parts to those described in FIG. 1, the hydrocarbon feed 10 is interrupted to the furnace and steam 20 continues passing through the furnace. The furnace effluent 90 is redirected away from the recovery section of the olefins plant (not shown) to atmosphere. Air is added via conduit 10 to the steam passing through the furnace to create a decoking feed air/steam mixture in conduit 25. The air/steam mixture is heated in radiant coils 40 to remove at least a portion of the coke deposits by controlled combustion. The effluent from radiant coils 40 is cooled in transfer line exchanger 50 and in quench fitting 60. The flow of quench oil in conduit 70 is halted via valve 72. Rather than water, steam ("quench steam") is injected to cool the decoking process effluent 90. Quench steam may be injected downstream of the quench fitting as indicated in FIG. 2 via conduit 110, valve 111 and conduit 112, or quench steam may be injected into the quench fitting via conduit 80, or quench steam may be divided between the two injection points. The rate of steam injection via conduit 110 or conduit 80 is controlled to achieve desired process effluent temperature in conduit 90.

Advantageously, because the quench steam does not produce stratified flow, it does not suffer from variations in measured temperature. The result is tighter control of the decoking process effluent temperature. Tighter control allows the target effluent temperature to be optimized and set closer to the upper metallurgical temperature limit of the downstream piping. The decoking process effluent temperature may be controlled ≤30° C. below the upper metallurgical temperature limit of the downstream piping. This provides a cost saving optimization by avoiding over quenching of the process effluent that can be realized, for example, in reduced quench steam demand.

Additionally, providing non-stratified (vapor phase only) flow that is substantially free of liquid water is especially well-suited, for example, when the decoking effluent is directed into the furnace firebox (connection not shown). In such applications, any liquid water entering the firebox would instantly vaporize with a corresponding rapid increase in volume that could damage the firebox insulation system.

Figure 3:
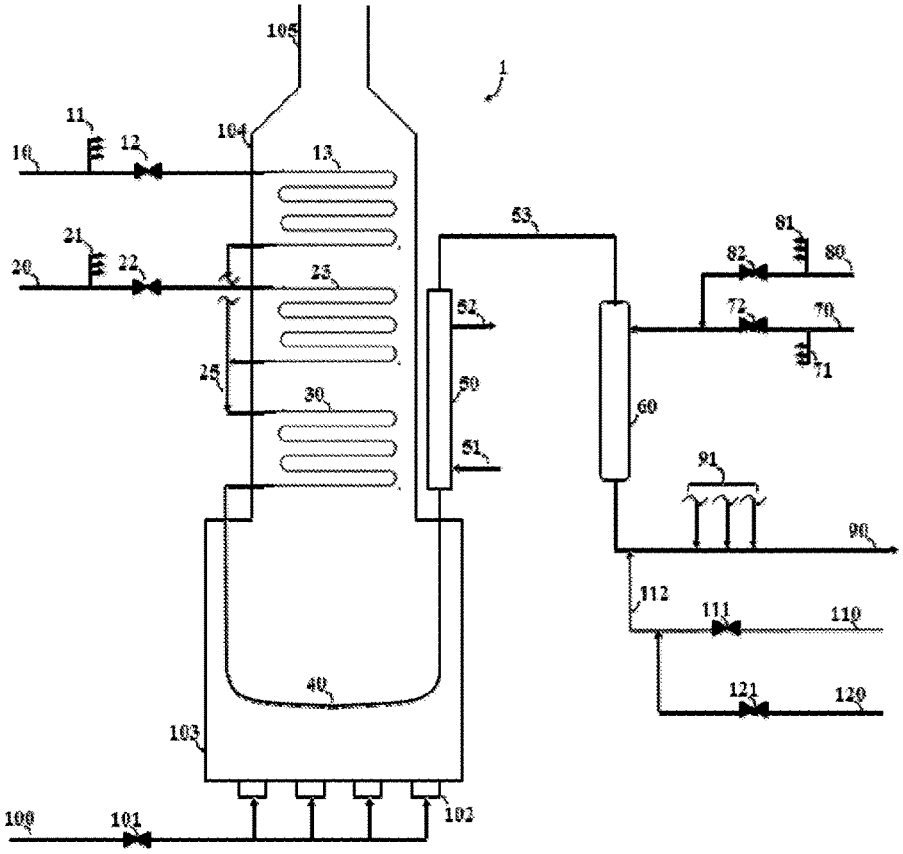
FIG. 3 illustrates a schematic diagram of a pyrolysis furnace and decoking process as disclosed herein, utilizing an optional desuperheating water connection.

Optionally, the amount of quench steam required to cool the decoking process effluent may be further reduced by adding liquid water to desuperheat the quench steam supply. The liquid water added to the quench steam absorbs heat lowering the temperature of the quench steam and the liquid water undergoes a phase change from liquid water into additional quench steam. FIG. 3, where like numerals indicate like parts to those described in FIG. 1 and FIG. 2, illustrates one potential embodiment of this option. Sufficient liquid water is injected via conduit 120 and valve 121 in order to substantially desuperheat the quench steam in conduit 112. For example, the quench steam may be desuperheated to about 3.5° C., 5° C., 7° C., 10° C., 15° C., or 25° C., above the quench steam saturation temperature. Optionally, the quench steam provided via conduit 80 may be desuperheated. Besides cost savings from reduced steam demand to cool the decoking process effluent, another advantage of desuperheating the quench steam is reduced velocity in the piping and corresponding reduced erosion rates from suspended coke particulates.

EXAMPLES

Example 1 (Comparative)

In this comparative example, a system as depicted in FIG. 1 is employed. Heavy gas-oil may be fed via conduit 10 at a rate of 91 Mg/hr (200 klb/hr). Quench oil may be provided via conduit 70 at a rate of 182 Mg/hr (400 klb/hr) to cool the furnace effluent. When decoking, the temperature in effluent conduit 53 can reach 580° C. (1075° F.). The equipment downstream of conduit 90 (not shown) may be made of carbon-steel and is designed to operate at temperatures below 449° C. (840° F.). Quench water may be injected via conduit 80 to cool the decoking effluent. Because of the stratified flow and resulting variability in decoking effluent temperature measurement discussed previously, the target effluent temperature is 315° C. (600° F.) achieved by a quench water flow rate of about 14 Mg/hr (31 klb/hr).

Since the quench oil fitting 60 in this example is designed for 182 Mg/hr (400 klb/hr) of quench oil flow, poor distribution results when only 14 Mg/hr (31 klb/hr) of quench water is injected into the quench oil fitting. As previously described, the maldistribution leads to stratification, mechanical fatigue, and variable temperature control.

Example 2

The same 91 Mg/hr (200 klb/hr) heavy gas oil feed used in Example 1 may be fed to a similar furnace configured as illustrated in FIG. 2. Again, the quench fitting 60 is designed for 182 Mg/hr (400 klb/hr) flow of quench oil. During decoking, instead of water, quench steam may be supplied via conduit 80 or via conduit 110 or via both conduit 80 and conduit 110 to cool the decoking process effluent. Since adding quench steam does not result in stratified flow, the target effluent temperature may be raised to 427° C. (800° F.) (closer to the carbon-steel temperature limits of 449° C. (840° F.)) and may be achieved using about 40 Mg/hr (88 klb/hr) of medium pressure 188° C. (370° F.) quench steam. Using quench steam avoids the problems of stratification, mechanical fatigue, and variable temperature control by eliminating the use of quench water.

Example 3

The same 91 Mg/hr (200 klb/hr) heavy gas oil feed used in Example 1 may be fed to a similar furnace configured as illustrated in FIG. 3. Again, the quench fitting 60 is designed for 182 Mg/hr (400 klb/hr) flow of quench oil. During decoking, instead of water, quench steam may be supplied via conduit 110 to cool the decoking process effluent. In order to minimize the rate of quench steam required, and hence reduce the velocity in the piping (to reduce erosion rates), quench steam that is close to its saturation temperature may be used. Since the operating pressure of conduit 90 may be about 0.82 atm gauge (12 psig) or less, the quench steam may be cooled to 121° C. (250° F.) (about 3.5° C. above the quench steam saturation temperature) with no risk of adding excess water to the decoking effluent. The decoking effluent may be cooled to the same 427° C. (800° F.) in conduit 90 as in Example 2 using about 34 Mg/hr (75 klb/hr) of desuperheated steam made up of about 1.3 Mg/hr (3 klb/hr) of desuperheating water (supplied via conduit 120) and about 32.7 Mg/hr (72 klb/hr) of 188° C. (370° F.) medium pressure steam (supplied via conduit 110). Less quench steam is required than was required in Example 2 which reduces volumetric flow rate and velocity in the piping, also reducing erosion rates.

Satisfactory decoking is achieved when the operation is conducted in accordance herewith. All patents, test procedures, and other documents cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the invention, including all features which would be treated as equivalents thereof by those skilled in the art to which the invention pertains.

What is claimed is:

1. A decoking process for removing coke formed during steam cracking of a liquid hydrocarbon feed in a furnace having a firebox, radiant coils, a transfer line exchanger, and an oil quench connection wherein liquid quench oil is injected to directly cool the steam-cracked hydrocarbon, the process comprising the steps of:

(a) stopping the flow of hydrocarbon feed comprising liquids to the furnace;

(b) stopping the flow of quench oil to the oil quench connection;

(c) supplying a decoking feed comprising steam and air to the furnace under conditions sufficient to at least partially combust coke accumulated on the interior of the radiant coils, the transfer line exchanger, and the oil quench connection; and (d) supplying a first portion of quench steam via the oil quench connection into the decoking process effluent, and supplying a second portion of quench steam to the decoking process effluent via a steam quench connection at a point downstream from the oil quench connection at sufficient flow to cool the decoking process effluent to a temperature less than 450° C.

2. The process of claim 1, wherein the decoking process effluent is substantially free of liquid water.

3. The process of claim 1, further comprising the preliminary step of adding liquid water to the second portion of quench steam in an amount sufficient to maintain the quench steam about 3.5° C. above the quench steam saturation temperature.

4. The process of claim 1, wherein sufficient quench steam is supplied to control the combined steam and decoking process effluent temperature ≤30° C. below the design temperature limit of downstream piping.

5. The process of claim 1, wherein the hydrocarbon feed in step (a) comprises a vapor stream from a vapor/liquid separator.

6. The process of claim 1, where the process does not include adding liquid water to the oil quench connection or to the second portion of quench steam.

7. The process of claim 1, further comprising the step of conducting the combined steam and decoking process effluent to the furnace firebox.

8. The process of claim 1, further comprising the step of conducting the combined steam and decoking process effluent to a cyclonic decoking drum.

9. The process of claim 1, wherein the oil quench connection is an oil quench fitting.

* * * * *